US006446360B1

(12) United States Patent
Sheets et al.

(10) Patent No.: US 6,446,360 B1
(45) Date of Patent: Sep. 10, 2002

(54) WATERPROOF FOOTWEAR LINER AND METHOD OF MAKING THE SAME

(75) Inventors: Allen G. Sheets, Albany; Richard Finney, Lancaster, both of OH (US)

(73) Assignee: Rocky Shoes & Boots, Inc., Nelsonville, OH (US)

( * ) Notice: Subject to any disclaimer, the term of this patent is extended or adjusted under 35 U.S.C. 154(b) by 0 days.

(21) Appl. No.: 09/829,422

(22) Filed: Apr. 9, 2001

(51) Int. Cl.[7] ..... A43B 23/07

(52) U.S. Cl. ..... 36/55; 36/10; 12/142 T; 12/145; 12/146 C

(58) Field of Search ..... 36/10, 55; 12/142 T, 12/145, 146 C

(56) References Cited

U.S. PATENT DOCUMENTS

| | | | | | |
|---|---|---|---|---|---|
| 2,724,676 | A | | 11/1955 | Randall et al. | 154/139 |
| 3,239,952 | A | | 3/1966 | Lange et al. | 36/2.5 |
| 3,350,795 | A | | 11/1967 | Schlecht | 36/2.5 |
| 3,530,595 | A | | 9/1970 | Vogel | 36/2.5 |
| 3,581,412 | A | | 6/1971 | Dalebout | 36/2.5 AL |
| 4,194,308 | A | | 3/1980 | Karlsson | 36/9 R |
| 4,790,082 | A | * | 12/1988 | Pozzebon | 36/10 |
| RE34,890 | E | | 4/1995 | Sacre | 36/55 |
| 5,499,459 | A | | 3/1996 | Tomaro | 36/10 |
| 5,526,584 | A | | 6/1996 | Bleimhofer et al. | 36/10 |
| 5,659,914 | A | * | 8/1997 | Steinlauf | 12/145 |
| 5,802,740 | A | | 9/1998 | Merk, Sr. | 36/55 |
| 5,964,047 | A | | 10/1999 | Covatch | 36/55 |
| 6,035,555 | A | * | 3/2000 | Pavelescu et al. | 36/12 |
| 6,088,935 | A | * | 7/2000 | Pavelescu et al. | 36/14 |
| 6,115,940 | A | | 9/2000 | Chen | 36/4 |

* cited by examiner

*Primary Examiner*—Ted Kavanaugh
(74) *Attorney, Agent, or Firm*—Porter, Wright, Morris & Arthur LLP

(57) ABSTRACT

A footwear liner includes two sides connected at a front seam and a back seam by stitching, an inner bottom piece connected to the two sides along a bottom seam by stitching, and an outer bottom piece adhered to the inner bottom piece. Each side includes an outer layer, an inner layer, and an intermediate layer that is impermeable to water and permeable to vapor. The outer bottom piece includes an outer layer and an inner layer that is impermeable to water and permeable to vapor. The two sides and the inner bottom piece cooperate to form a partial enclosure with a toe portion, a heel portion, and an open top portion. In the preferred embodiment, the front and back seams are covered by a sealing tape to waterproof the seams, and the outer bottom piece overlaps and is adhered to portions of the sides adjacent the bottom seam to form a waterproof seal between the outer bottom piece and the sides.

20 Claims, 6 Drawing Sheets

WATERPROOF FOOTWEAR LINER AND METHOD OF MAKING THE SAME

FIELD OF THE INVENTION

The present invention generally relates to a footwear liner, and, more particularly, to a waterproof footwear liner.

BACKGROUND OF THE INVENTION

It is known in the art to use a waterproof liner (or "bootie") as an insert in an article of footwear to protect a wearer's foot from water and to provide comfort and warmth to the wearer's foot. U.S. Pat. Nos. Re. 34,890 to Sacre, 5,499,459 to Tomaro, and 5,526,584 to Bleimhofer et al. describe such waterproof booties.

The composition of such waterproof booties varies. In some booties, the waterproof material defines a continuous barrier that surrounds a user's foot while in others the waterproof material is not continuous,, allowing water to come into contact with a user's foot. Some booties are constructed of material that is vapor permeable/water impermeable while others are constructed of material that is both vapor and water impermeable.

The method of manufacturing such waterproof booties also varies. Some of the manufacturing processes used are labor intensive and time-consuming and some manufacturing processes do not result in a completely waterproof shoe construction. For example, in one method of making such a bootie, two fabric bootie side portions are stitched together to form a generally tubular shape. The tubular bootie is inserted within a shoe upper and the upper end of the bootie is secured to the shoe upper near the top edge of the upper, generally by stitching. A sole shaped board bottom is temporarily adhered to a shoe last by adhesive, tacks, or other suitable fasteners. The last with attached board bottom is placed within the bootie and shoemaking equipment is used to roll the lower edge of the bootie and shoe upper under the perimeter of the board bottom and secure them in position with cement. An outsole is then secured to the shoe upper and bootie using conventional methods. During this process, the waterproof lining may be damaged when rolling the lower edge of the bootie around the board bottom. If the excess material present at the lower edge of the bootie is not carefully eased into position when the bootie edge is rolled under the board bottom, folds or gaps also may result that allow faster penetration of water into the interior of the shoe.

Accordingly, there is a need in the art for a waterproof footwear liner that is easy to manufacture and that is produced using a process that has less of a potential to damage the waterproof lining of the bootie being produced.

SUMMARY OF THE INVENTION

The present invention provides a footwear liner which overcomes at least some of the above-noted problems of the related art. According to the present invention, a footwear liner is provided that comprises two sides connected at a front seam and a back seam by stitching, an inner bottom piece connected to the two sides along a bottom seam by stitching, and an outer bottom piece adhered to the inner bottom piece. Each side includes an outer layer, an inner layer, and an intermediate layer and the bottom includes an outer layer and an inner layer. The intermediate layer of each side and the inner layer of the outer bottom piece are impermeable to water and permeable to vapor. The two sides and the inner bottom piece cooperate to form a partial enclosure with a toe portion, a heel portion, and an open top portion.

In one preferred embodiment, each of the front and back seams are covered by a sealing tape such that the seams are waterproofed. In another preferred embodiment, the outer bottom piece extends outwardly beyond the seamed edge of the inner bottom piece to overlap portions of the sides adjacent the bottom seam. The overlapping portions of the outer bottom piece are adhered to the sides adjacent the bottom seam such that a waterproof seal is formed between the outer bottom piece and the sides.

The inner bottom piece is preferably formed from a flexible material, such as a oven or nonwoven fabric. The outer and inner layers of each side and the outer layer of the outer bottom piece are preferably formed from an abrasion-resistant material. Each side may further comprise a second intermediate layer formed from an insulating material and positioned between the intermediate layer and the inner layer.

According to another aspect of the present invention, a waterproof footwear liner is provided that comprises two sides connected at a front seam and a back seam and an inner bottom piece connected to the two sides along a bottom seam by stitching. Each of the front and back seams are waterproofed. An outer bottom piece is adhered to the inner bottom piece and to overlapped portions of the sides adjacent the bottom seam to form a waterproof seal between the sides and the outer bottom piece. Each side includes an outer layer, an inner layer, and an intermediate layer and the outer bottom piece includes an outer layer and an inner layer. The intermediate layer of each side and the inner layer of the outer bottom piece are impermeable to water and permeable to vapor. The two sides and the inner bottom piece cooperate to form a partial enclosure with a toe portion, a heel portion, and an open top portion.

In a preferred embodiment, the two sides are connected at the front seam and the back seam by stitching and each of the front and back seams are covered by a sealing tape.

Additional features and advantages of various preferred embodiments will be better understood in view of the detailed description provided below.

It should be understood that the appended drawings are not necessarily to scale. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

The following detailed discussion of various alternative and preferred embodiments will illustrate the general principles of the present invention with reference to a waterproof liner to be inserted into an article of footwear such as, for example, a shoe or a boot. Other embodiments suitable for other applications will be readily apparent to those skilled in the art given the benefit of this disclosure.

Figure 1:
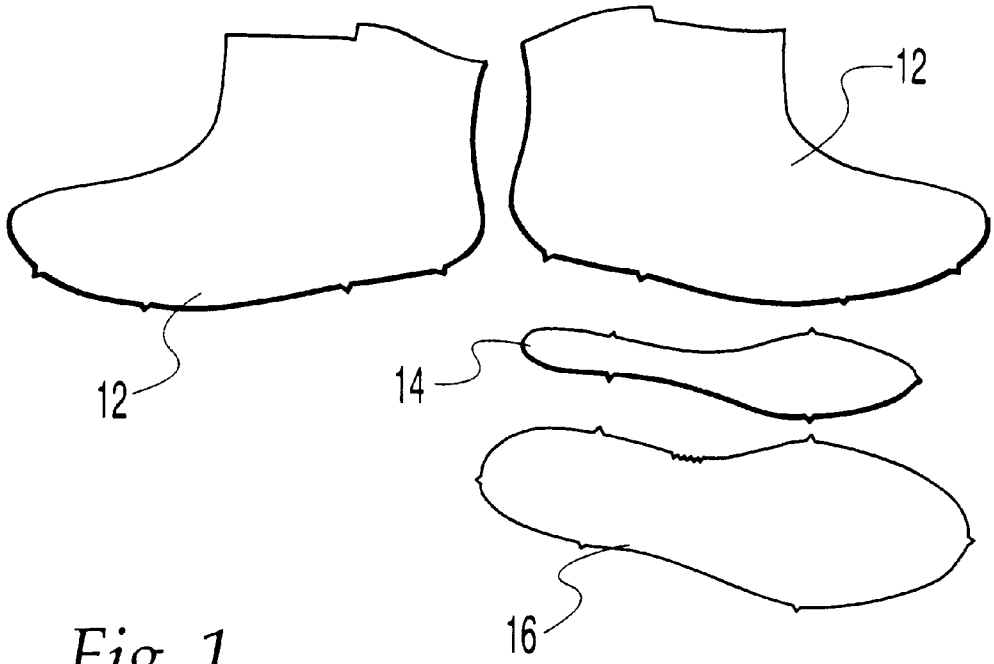
FIG. 1 is a perspective view of parts of a footwear liner according to a preferred embodiment of the present invention shown before assembly and including two sides, an inner bottom piece, and an outer bottom piece.

Referring now to the drawings, FIGS. 1–12 together illustrate a preferred embodiment of a waterproof footwear liner 10 according to the present invention. The waterproof footwear liner 10 preferably comprises two sides 12, an inner bottom piece 14, and an outer bottom piece 16. FIG. 1 illustrates the sides 12, inner bottom piece 14, and outer bottom piece 16 of the preferred embodiment before assembly of the waterproof footwear liner 10.

Figure 2:
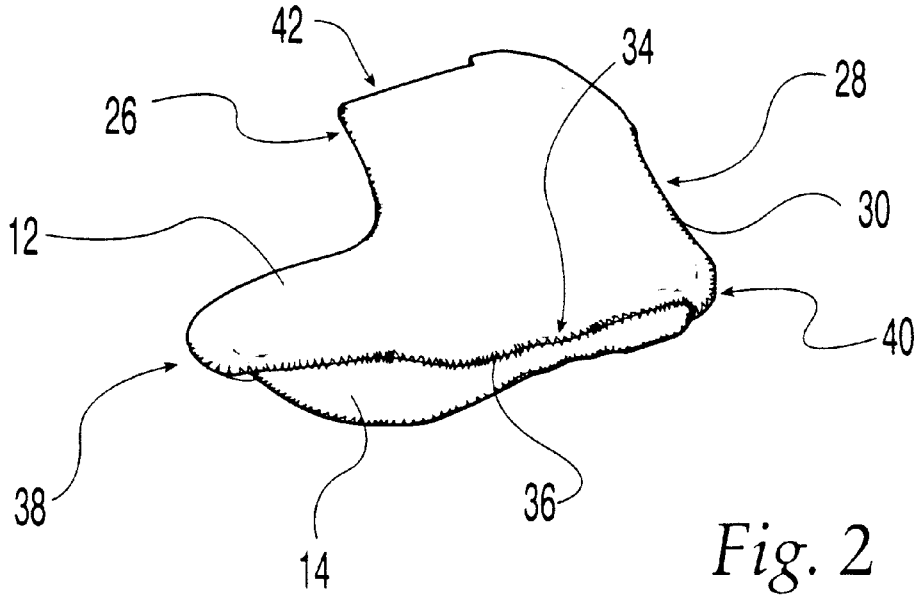
FIG. 2 is a perspective view of a partially assembled footwear liner according to a preferred embodiment of the present invention showing the side and inner bottom pieces of FIG. 1 stitched together along front, back, and bottom seams.
Figure 3:
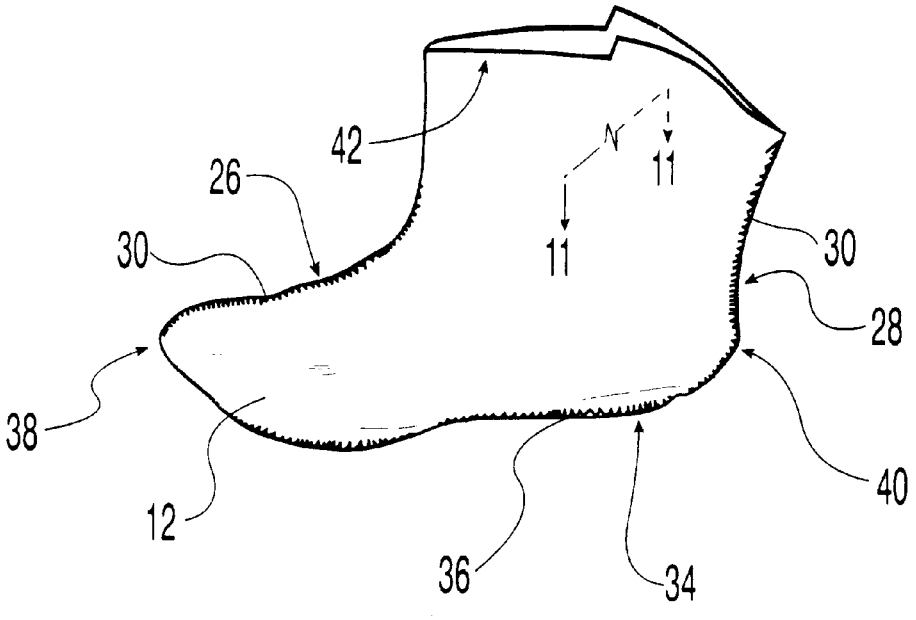
FIG. 3 is another perspective view of the partially assembled footwear liner of FIG. 2.
Figure 4:
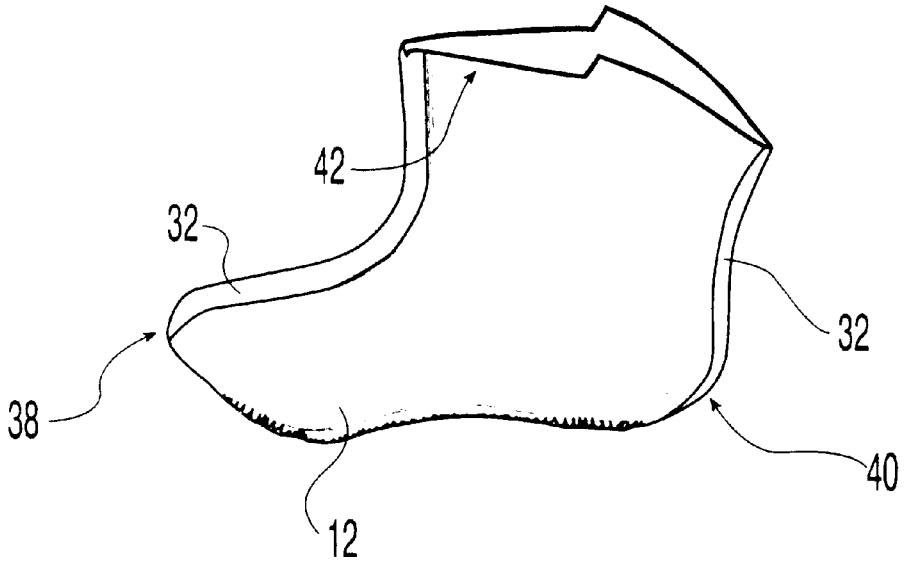
FIG. 4 is a perspective view of the partially assembled footwear liner of FIG. 2 shown with sealing tape adhered to the front and back seams.
Figure 5:
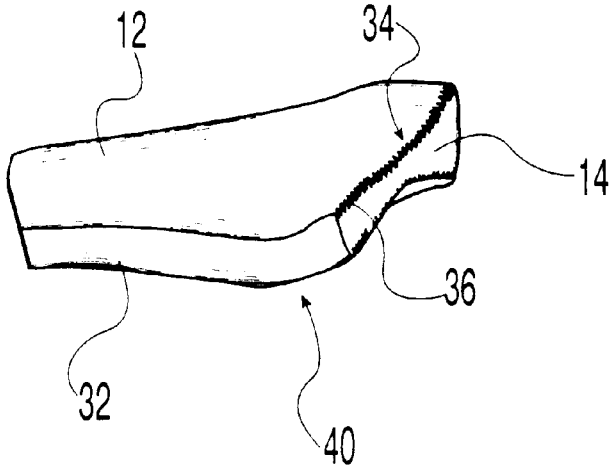
FIG. 5 is a rear perspective view of the partially assembled footwear liner of FIG. 4.
Figure 6:
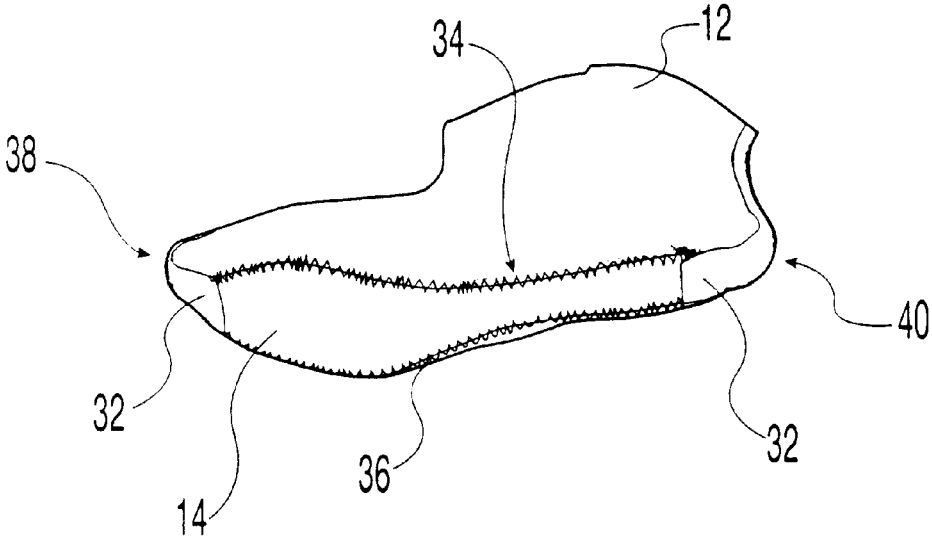
FIG. 6 is a bottom perspective view of the partially assembled footwear liner of FIG. 4.

As best illustrated in FIGS. 2 and 3, the two sides 12 are connected at a front seam 26 and a back seam 28, preferably by stitching 30. Each of the front 26 and back 28 seams are preferably waterproofed. In the preferred embodiment and as best illustrated in FIGS. 4–6, a sealing tape 32 (such as, for example, a nylon reinforced hot melt tape) is activated by heating and applied over the seams 26, 28 to waterproof the seams 26, 28. It will be recognized by those skilled in the art that liners having the sides 12 connected and the front and back seams 26, 28 waterproofed using other methods (such as, for example, by sealing or adhering the sides 12 together at the seams 26, 28 without the use of stitching 30) are also included in the present invention. Depending on the desired contour of the liner 10, it also may be possible to form the two sides 12 as a unitary member without a back seam or otherwise form the sides 12 using one, two or more side components of various configurations (not shown in the drawings).

Figure 11:
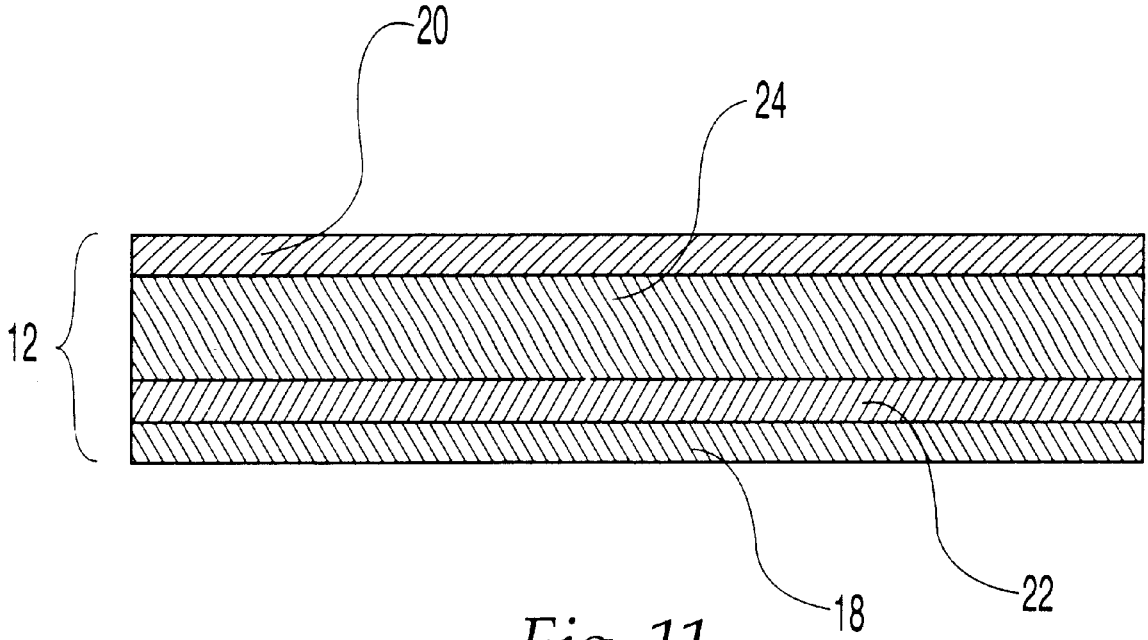
FIG. 11 is a fragmentary cross sectional view taken along line 1—1 of FIG. 3 showing the layers of one side of the liner.

As best illustrated in FIG. 11, each side 12 is preferably a laminate having at least an outer layer 18, an inner layer 20, and an intermediate layer 22. The intermediate layer 22 is preferably formed from a material that is impermeable to water and permeable to vapor, such as, for example, a membrane of polytetrafluoroethylene or other suitable material. The outer 18 and inner 20 layers of the sides 12 are preferably formed from an abrasion-resistant material (such as, for example, nylon tricot) to avoid wear on the liner 10 and damage to the intermediate layer 22. Such wear could occur due to rubbing of a user's foot on the inner layer 20 or rubbing of the outer layer 18 on the interior of the article of footwear in which the liner 10 is inserted. The outer 18 and inner 20 layers of the sides also must be vapor permeable.

A second intermediate layer 24 may be added to the sides 12 between the intermediate layer 22 and the inner layer 20. The second intermediate layer 24 may be formed from a material with cushioning and/or insulating properties, such as foam or nonwoven synthetic fiber insulation such as Thinsulate®(available from 3M Corp.), to provide greater comfort to a user.

As best illustrated in FIG. 2, the inner bottom piece 14 is connected to the sides 12 along a bottom seam 34, preferably by stitching 36. However, liners having the inner bottom piece 14 connected to the sides 12 using other methods (such as, for example, adhering the inner bottom piece 14 to the sides at the bottom seam 34 without the use of stitching 36) are also included in the present invention. The inner bottom piece 14 is preferably formed from a flexible material, such as a nonwoven or woven fabric with high stitch tear strength. Most preferably, a nonwoven material is used to form the inner bottom piece 14. A suitable material is a resin impregnated reinforced synthetic fiber product such as Bon-Stitch 55 (comprised of 50% synthetic fibers, 20% polypropylene textile reinforcement and 30% synthetic resin, available from Bontex, Buena Vista, Va.). Other suitable materials, such as needle-punched nylon, also may be used. The two sides 12 and the inner bottom piece 14 cooperate to form a partial enclosure with a toe portion 38, a heel portion 40, and an open top portion 42 (best illustrated in FIG. 3). The liner 10 is designed to accept a wearer's foot and keep the wearer's foot dry from water contacting the liner 10 below the open top portion 42,. The liner 10 also may be designed to keep the wearer's foot comfortable or warm (when a second intermediate layer 24 of cushioning or insulating material is included in the sides 12).

Figure 7:
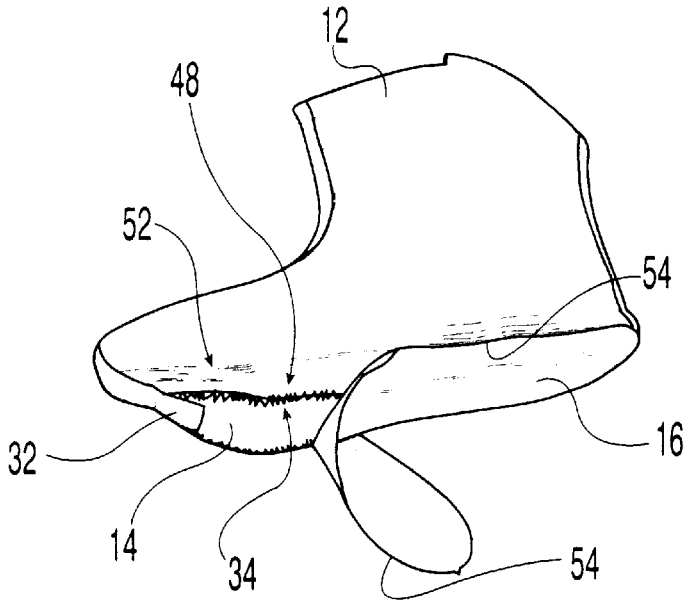
FIG. 7 is a perspective view of the partially assembled footwear liner of FIG. 4 shown with an outer bottom piece partially adhered to the inner bottom piece and to overlapped portions of the sides.
Figure 8:
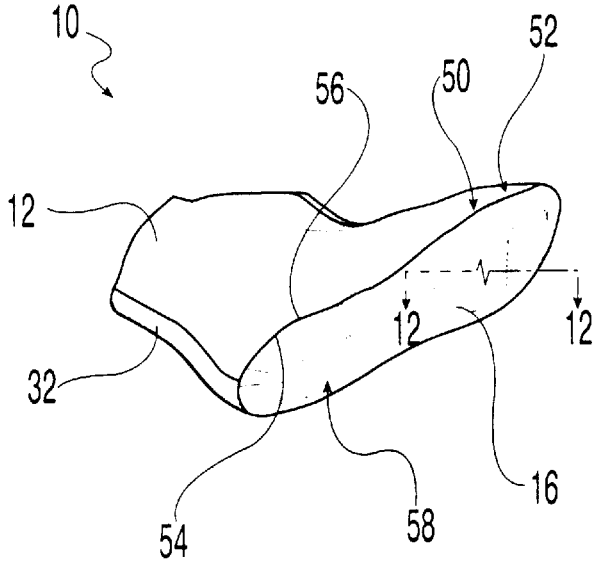
FIG. 8 is a perspective view of a fully assembled waterproof footwear liner according to a preferred embodiment of the present invention.
Figure 9:
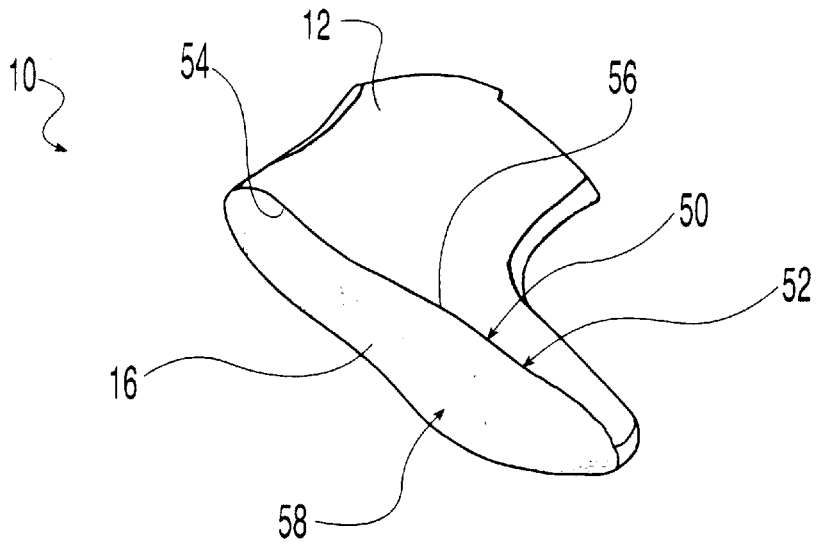
FIG. 9 is another perspective view of the fully assembled waterproof footwear liner of FIG. 8.
Figure 10:
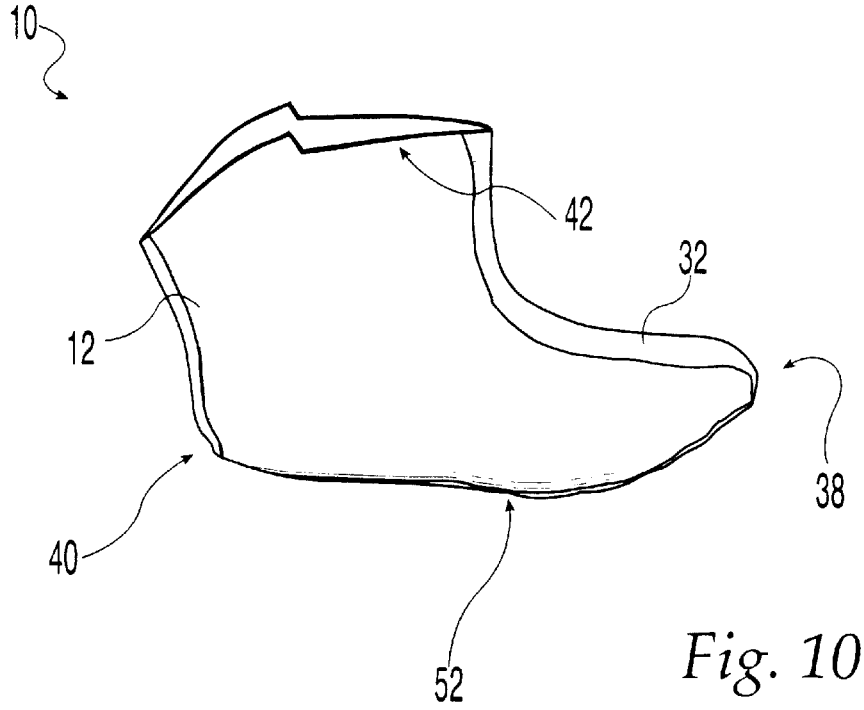
FIG. 10 is yet another perspective view of the fully assembled waterproof footwear liner of FIG. 8.

In the preferred embodiment and as best illustrated in FIGS. 7–9, the outer bottom piece 16 is sized to completely cover the inner bottom piece 14 and overlap portions 48 (FIG. 7) of the sides 12 adjacent to the bottom seam 34. As illustrated in FIG. 7, the outer bottom piece 16 is connected to the inner bottom piece 14. In the preferred embodiment, the outer bottom piece 16 is adhered to the inner bottom piece 14 and to the overlapped portions 48 of the sides 12 to form the fully assembled liner 10 as shown in FIGS. 8–10. As more fully discussed below, various adhesives may be used to connect the outer bottom piece 16 to the inner bottom piece 14 and to the overlapped portions 48 of the sides 12.

Figure 12:
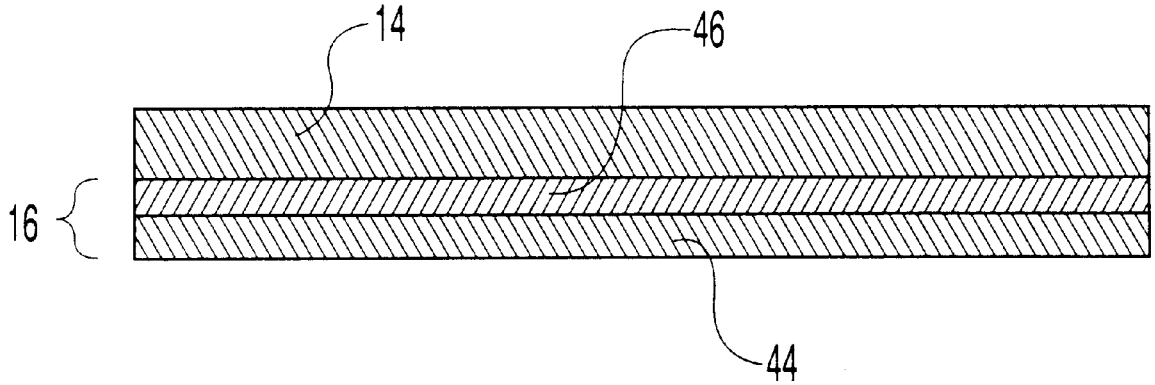
FIG. 12 is a fragmentary cross sectional view taken along line 12—12 of FIG. 8 showing the layers of the outer bottom piece and the inner bottom piece.

As illustrated in FIG. 12, the outer bottom piece 16 is preferably a laminate comprising at least an outer layer 44 and an inner layer 46. The outer layer 44 is preferably formed from an abrasion-resistant material (such as, for example, nylon tricot) to avoid frictional wear between the outer bottom piece 16 and the interior of the article of footwear. The inner layer 46 is preferably formed from a material that is impermeable to water and permeable to vapor, such as, for example, a membrane of polytetraflouroethylene or other suitable material. In the preferred embodiment, when the outer bottom piece 16 is adhered to the inner bottom piece 14 and to the overlapped portions 48 of the sides 12, a waterproof seal 50 (FIGS. 8 and 9) is formed between the sides 12 and the outer bottom 16.

As illustrated in FIGS. 8 and 9, a lower surface 58 of the liner 10 defines a perimeter 52,56 spaced a distance from the bottom seam 34 and corresponding to the feather edge of a last inserted within the partially assembled liner 10. The outer edge 54 of the outer bottom piece 16 extends substantially to the perimeter 56 of the lower surface 58. Thus, the perimeter 56 corresponds substantially to the area 48 of the liner 10 overlapped by the outer bottom piece 16. The perimeter 56 may be marked on the lower surface 58 of the liner 10 to guide the application of adhesive for securing the liner 10 to the outer bottom piece 16.

The present invention also includes a method of forming a waterproof footwear liner 10. In a preferred method of forming the waterproof footwear liner 10, two sides 12 and an inner bottom piece 14 are first provided. Each side 12 is preferably a laminate having at least an outer layer 18, an inner layer 20, and an intermediate layer 22 as described above. The two sides 12 are joined along a front seam 26 and a back seam 28 (preferably by stitching 30), and the inner bottom piece 14 is joined to the two sides 12 along a bottom seam 34 (preferably by stitching 36). As described above, other methods of joining the sides 12 and inner bottom piece 14 such as, for example, sealing or adhering the seams 26, 28, 34, are also included in the present invention.

Next, the front and back seams 26, 28 are waterproofed. In the preferred embodiment, this is accomplished by activating a sealing tape 32 (such as, for example, nylon reinforced hot melt tape) by heating and applying the activated tape 32 to the front and back seams 26, 28. Other methods of waterproofing the front and back seams 26, 28 such as, for example, using seated or adhered seams, may also be used in the present invention.

The partially assembled liner is next placed over an appropriately sized last. The feather edge of the last corresponds to the perimeter 52, 56 of a lower surface 58 of the partially assembled liner.

An outer bottom piece 16 is provided that is preferably a laminate comprising an outer layer 44 and an inner layer 46. As discussed above, the inner layer 46 is preferably impermeable to water and permeable to vapor. The outer bottom piece 16 is preferably sized to overlap portions 48 of the sides 12 and preferably has an outer edge 54 that extends substantially to the perimeter 52, 56 of the line.

The outer bottom piece 16 is adhered to the inner bottom piece 14 and to the overlapped portions 48 of the sides 12 to form a waterproof seal 50 between the sides 12 and the outer piece 16. The outer bottom 16 may be adhered using various adhesives. In one preferred embodiment, a heat activated cement, preferably a polyurethane cement, is applied to the outer bottom piece 16, to the inner bottom piece 14, and to portions 48 of the sides 12 of the partially assembled liner. The cement is heat activated and the outer bottom 16 and the partially assembled liner are then pressed together and allowed to bond. In another preferred embodiment, a contact cement (such as, for example, rubber or neoprene contact cement) is used to bond the outer bottom 16 and the partially assembled liner. The outer bottom 16 and the partially assembled liner are pressed together while the contact cement is still wet and are allowed to bond together.

Once the waterproof footwear liner 10 is completed, the liner 10 may be inserted into an article of footwear that the liner 10 is sized to fit. Typically, the upper edge of the liner 10 is secured, by stitching or another suitable method, to the upper edge of the footwear. The waterproof liner 10 may also be connected to the interior of the article of footwear. For example, an adhesive may be used to join the outer bottom 16 to the interior bottom of the article of footwear or to join the toe portion of the liner 10 to the interior toe portion of the article of footwear.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to use the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A footwear liner, comprising:

two sides sealingly connected at a front seam and a back seam, each side having an outer layer, an inner layer, and an intermediate layer, the intermediate layer being impermeable to water and permeable to vapor, the sides defining a lower edge and a perimeter adjacent to the lower edge;

an inner bottom piece having a border connected to the lower edge of the sides along a bottom seam to form a partial enclosure, the partial enclosure having an open top portion, a toe portion, a heel portion, and a sole portion, the perimeter of the sides and the inner bottom piece cooperating to form the sole portion; and an outer bottom piece comprising an outer layer and an inner layer, the inner layer being impermeable to water and permeable to vapor, the outer bottom piece extending outwardly beyond the bottom seam in overlapping relationship to the perimeter of the sides, the outer bottom piece being adhered to the inner bottom piece and the overlapped perimeter of the sides to form a waterproof seal between the outer bottom piece and the sides.

2. The footwear liner of claim 1, wherein the perimeter extends away from the lower edge to a position corresponding to the location of a feather edge of a shoe last received within the partial liner enclosure.

3. The footwear liner of claim 1, wherein the outer bottom piece covers a lower surface of the liner corresponding generally to the shape of the bottom of a user's foot.

4. The footwear liner of claim 1, wherein the border of the inner bottom piece is spaced inwardly from an outline of the bottom of a user's foot.

5. A footwear liner, comprising:

a tubular side member having an outer layer, an inner layer, and an intermediate layer, the intermediate layer being impermeable to water and permeable to vapor, the side member defining a lower edge and a perimeter adjacent to the lower edge;

an inner bottom piece having a border connected to the lower edge of the side member along a bottom seam to form a partial enclosure, the partial enclosure having an open top portion, a toe portion, a heel portion, and a sole portion consisting essentially of the perimeter of the side member and the inner bottom piece, the sole portion corresponding generally to the shape of the bottom of a user's foot; and an outer bottom piece comprising an outer layer and an inner layer, the inner layer being impermeable to water and permeable to vapor, the outer bottom piece covering the inner bottom piece and bottom seam and extending outwardly therefrom in overlapping relationship to the perimeter of the side member, the outer bottom piece being adhered to the inner bottom piece and the overlapped perimeter of the side member to form a waterproof seal between the outer bottom piece and the side member.

6. The waterproof footwear liner of claim 5, wherein the perimeter of the side member extends away from the lower edge to a position corresponding to the feather edge of a shoe last received within the partial enclosure.

7. The waterproof footwear liner of claim 6, wherein the outer bottom piece extends in sealing relationship to a position on the side member corresponding to the feather edge of a shoe last received within the partial enclosure.

8. The waterproof footwear liner of claim 5, wherein the outer bottom piece is generally flat.

9. The waterproof footwear liner of claim 5, wherein the inner bottom piece defines a maximum length shorter than a length corresponding to the length of a user's foot measured from toe to heel and a maximum width shorter than a width corresponding to the width of a user's foot.

10. The waterproof footwear liner of claim 9, wherein the maximum width is approximately half the width of a user's foot.

11. The waterproof footwear liner of claim 5, wherein the inner bottom piece corresponds to a central portion of a user's foot, the border of the inner bottom terminates at a distance spaced inwardly from an outline of the bottom of a user's foot, and the bottom seam is located between an outline of a user's foot and a central portion of a user's foot.

12. The footwear liner of claim 5, wherein the inner bottom piece is formed from a nonwoven material.

13. The footwear liner of claim 12, wherein the inner bottom piece is formed from resin-impregnated synthetic fibers.

14. The footwear liner of claim 5, wherein the outer and inner layers of the side member are formed from an abrasion-resistant material.

15. The footwear liner of claim 5, wherein the side member further comprises a layer selected from a cushioning material and an insulating material positioned between the inner layer and the water impermeable layer.

16. The footwear liner of claim 15, wherein the side member further comprises a second intermediate layer positioned between the inner layer and the first intermediate layer, the second intermediate layer being selected from a cushioning material and an insulating material.

17. The footwear liner of claim 5, wherein the outer layer of the outer bottom piece is formed from an abrasion resistant-material.

18. The footwear liner of claim 5, wherein the tubular side member comprises left and right sides connected at a front seam and a back seam.

19. A footwear liner, comprising:

a tubular side member having an outer layer, an inner layer, and an intermediate layer, the outer and inner layers being formed from an abrasion-resistant material and the intermediate layer being impermeable to water and permeable to vapor, the side member defining a lower edge and a perimeter adjacent to the lower edge;

an inner bottom piece formed from resin-impregnated synthetic fibers, the inner bottom piece having a border spaced inwardly from an outline of the bottom of a user's foot, the border being connected to the lower edge of the side member along a bottom seam to form a partial enclosure, the partial enclosure having a an open top portion, a toe portion, a heel portion, and a sole portion corresponding generally to the shape of the bottom of a user's foot, the perimeter of the side member and the inner bottom piece cooperating to form the sole portion, the perimeter extending away from the lower edge to a position corresponding to the feather edge of a shoe last received within the partial enclosure; and an outer bottom piece comprising an outer layer formed from an abrasion-resistant material and an inner layer impermeable to water and permeable to vapor, the outer bottom piece covering the inner bottom piece and bottom seam and extending outwardly therefrom in overlapping relationship to the perimeter of the side member, the outer bottom piece being adhered to the inner bottom piece and the overlapped perimeter of the side member to form a waterproof seal between the outer bottom piece and the side member.

20. The footwear liner of claim 19, wherein the tubular side member comprises left and right sides connected at a front seam and a back seam.

* * * * *